United States Patent [19]

Nitsche

[11] 3,999,764

[45] Dec. 28, 1976

[54] GOLF COURSE

[76] Inventor: George P. Nitsche, 501 Talbot Ave., Winnipeg, Manitoba, Canada

[22] Filed: July 21, 1975

[21] Appl. No.: 597,535

[52] U.S. Cl. ..... 273/176 AB; 273/176 G; 273/181 B; 273/176 A

[51] Int. Cl.[2] ..... A63B 69/36

[58] Field of Search .... 273/176 AB, 176 G, 181 B, 273/181 K, 176 R, 176 B, 176 E, 176 F, 176 FA, 176 FB

[56] References Cited

UNITED STATES PATENTS

| | | | |
|---|---|---|---|
| 1,012,820 | 12/1911 | Cory | 273/181 K |
| 2,550,480 | 4/1951 | Hubbard | 273/176 AB X |
| 3,601,406 | 8/1971 | Giusti | 273/181 B X |

FOREIGN PATENTS OR APPLICATIONS

| | | | |
|---|---|---|---|
| 200,554 | 7/1923 | United Kingdom | 273/181 K |

*Primary Examiner*—George J. Marlo
*Attorney, Agent, or Firm*—Stanley G. Ade

[57] ABSTRACT

A golf course is laid out around a central core with the individual golf holes extending radially from the core. The core comprises a plurality of substantially rigid vertical panels, topped by panels of wire mesh or the like. Mirror images of the holes are drawn or displayed on the vertical panels and traps and water hazards on the panels are provided with a plurality of pins or spikes extending therefrom. The potting cup image on the panel may take the form of an aperture permitting a hole-in-one to be scored. A light weight practice ball is used to tee off and is driven against the vertical panel whereupon it rebounds onto the grass at which time a regular ball is substituted for chipping and putting. If the practice ball strikes a hazard on the panel, it is held by the spikes and penalty shots can be taken. This arrangement allows a golf course to be laid out in a relatively small area yet still retaining full action for the game.

2 Claims, 3 Drawing Figures

GOLF COURSE

BACKGROUND OF THE INVENTION

It is well known that full sized regulation golf courses take up considerable room and are relatively expensive not only to lay out but also to maintain.

Attempts have been made to reduce the area required for such golf courses and the well known par 3 type courses and miniature golf courses are examples of these attempts.

However, even a par golf course takes considerable room and requires considerable maintenance whereas a miniature golf course is normally restricted to putting stroke only.

SUMMARY OF THE INVENTION

The present invention overcomes the disadvantages as to area yet at the same time retains the majority of the full strokes, chipping and putting required for a game of golf.

Each individual hole permits a different par depending upon the hazards and the relationship between the tee and hole.

The principal object and essence of the invention is to provide a golf course of the character herewithin described which enables a full game to be played in a relatively restricted area, the well known practice ball being used for the driving shots and a regular ball for the chipping and putting strokes.

Another object of the invention is to provide a device of the character herewithin described which enables hazards to be engaged by the practice ball so that penalty strokes can be taken in the usual manner.

Still another object of the invention is to provide a device of the character herewithin described which, due to the fact that a practice ball is used, reduces any danger to adjacent participants thus enabling the individual holes to be placed around a central core area in a relatively restricted space.

Still another object of the invention is to provide a device of the character herewithin described in which the drive is against a vertical panel whereupon the ball rebounds at which time a regular ball may be substituted for chipping and putting.

A still further object of the invention is to provide a device of the character herewithin described in which various hazards can be introduced into the individual holes duplicating hazards normally encountered in a full size course.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
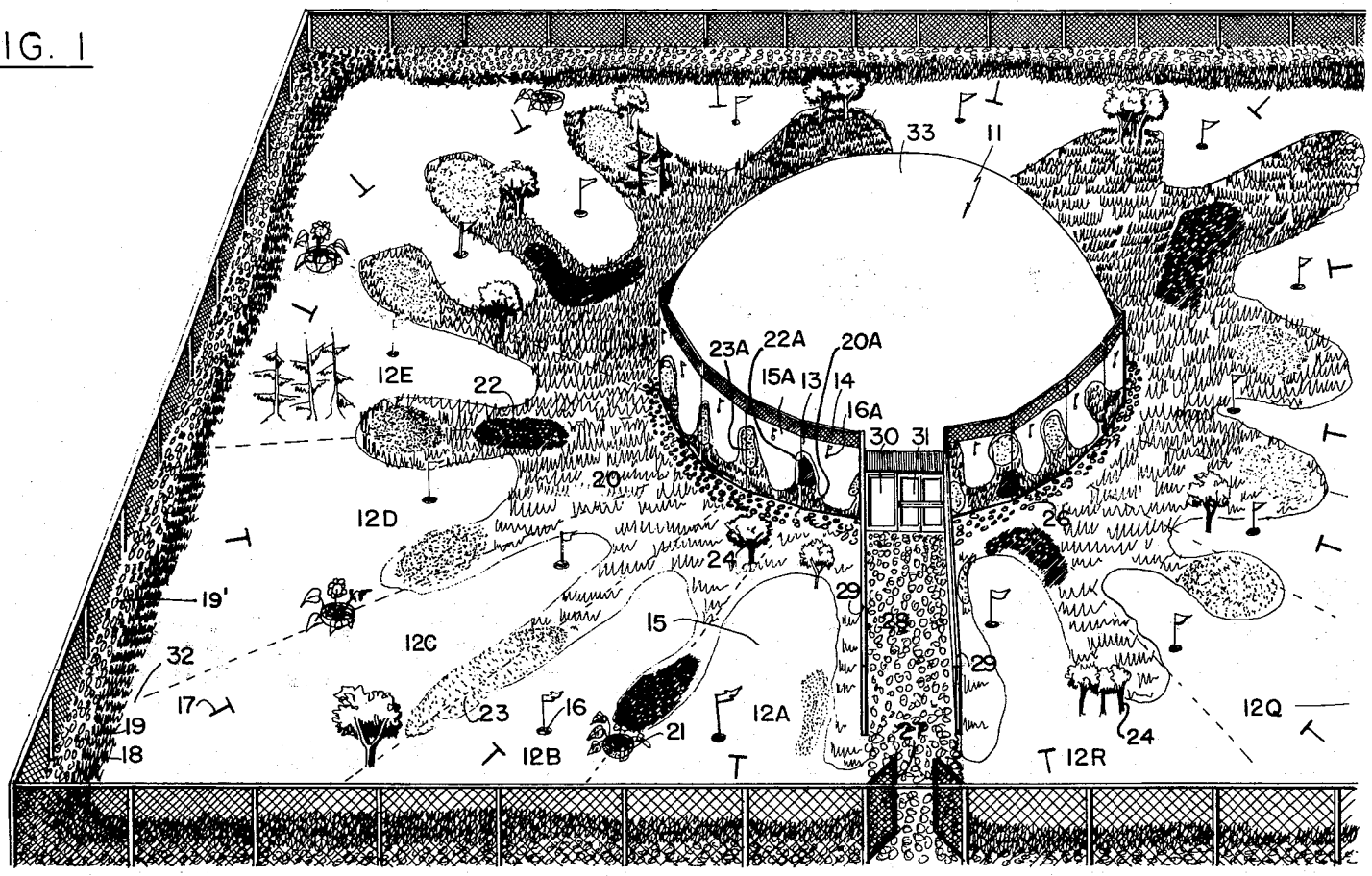
FIG. 1 is a partial isometric view of the golf course and central core.
Figure 3:
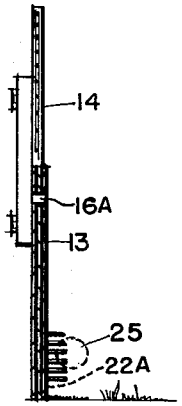
FIG. 3 is a fragmentary cross section through one side of the core along the line 3—3 of FIG. 2.
Figure 2:
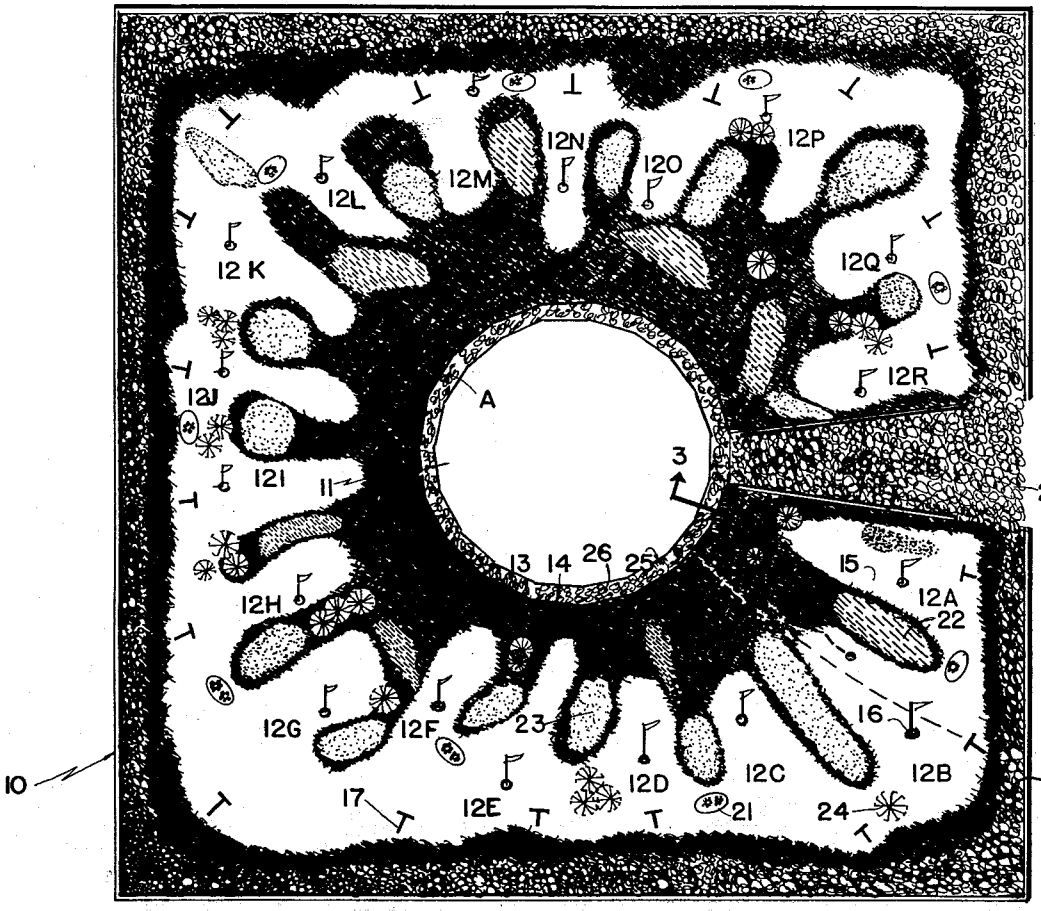
FIG. 2 is a top plan view of FIG. 1.

Proceeding therefore to describe the invention in detail, the embodiment shown is enclosed within a rectangular fenced area collectively designated 10.

It is desirable that the area enclosed by the fence 10 is approximately 140 ft. × 140 ft. but of course this area can be increased or decreased as desired and having regard to the availability of land.

Situated centrally within the rectangular enclosure 10 is a central core collectively designated 11 and the individual golf holes 12A, 12B, 12C, etc. extend radially from this core towards the boundary fence 10.

The core 11 includes a wall which in this embodiment comprises a plurality of vertical panels 13 situated in side by side arrangement to form an annular wall and each panel is of a rigid material to permit a light weight practice ball to rebound therefrom.

A relatively small wire mesh panel 14 is secured to the upper edges of the individual panels 13 and extend upwardly therefrom to restrain wild shots from leaving the general area.

Each individual golf hole 12A, 12B, 12C, etc. is a pie shaped configuration extending from the individual panel 13 and the terrain may vary depending upon the design parameters of the golf architect.

As an example, each hole will include a relatively smooth grassed area 15 which will include a conventional putting cup 16 and a tee area 17. The tee areas are preferably placed adjacent the outer boundaries 18 of the smooth grassed areas 15 whereas the putting cups may vary depending upon the par characteristics of the individual holes.

Preferably the smooth grassed areas 15 are bounded on the outer perimeter by rough grass area 19 extending around the entire course with a gravel path area 19' extending between the rough grass area 19 and the perimeter fence 10 so that access to all of the holes can be obtained readily and easily without infringing upon the individual playing areas.

Desirably, an inner rough grass area 20 extends from the inner boundary of the smooth grassed areas 15 and may vary in shape and configuration as desired. This rough grassed area can be flat or may be contoured depending upon circumstances and may contain hazards such as flower beds 21, ponds or water hazards 22, sand traps 23 and trees 24.

The majority of each individual hole is mirrored upon the individual panels 13, the exception being the tee areas 17 and in this connection corresponding hazards have been given corresponding numbers with an A suffix attached.

Reference character 15A indicates the smooth grass mirror image upon the panels with reference character 20A indicating the rough grassed areas. The hazard 22A and 23A are provided with a plurality of spikes or pins 25 extending outwardly from the area defining the hazard and these pins or spikes are placed closely enough together so that a conventional light weight practice ball, impinging within the hazard area upon the panels 13, will be held thereby. This will enable penalty shots to be taken as in the normal game of golf.

By the same token, the putting cup image 16A on the individual panels is preferably an aperture extending through the panel so that a hole-in-one can be scored if the practice ball strikes the putting cup 16A after the drive from the tee area 17.

An inner perimetrical gravel path 26 may extend around the base of the panels 13 for access purposes.

In the embodiment illustrated, an entrance gateway 27 is provided within the perimetrical fence 10 and a portion 28 is enclosed between a pair of vertically positioned, radially extending fences 29 to form a pay wicket area 30 and access doors 31 to the interior of the core 11.

In operation, the golfer tees off from the first tee area 17 and drives a light weight apertured practice ball or the equivalent towards the putting cup representation 16A on the vertical panel 13 relating to the hole being played.

The practice ball normally will strike the panel 13 and rebound therefrom either into the rough grass area 20 or the smooth grass area 15. It may strike a simulated hazard 22A or 23A and be held thereby whereupon a penalty stroke may be taken. Alternatively when rebounding, it may enter a hazard 22 or 23 whereupon penalty strokes may be taken or the ball may be played as it lies. Normally, once the tee shot has been made and the ball has rebounded onto the playing area, a regular golf ball is substituted and the ball is then chipped and/or putted towards the individual putting cup 16 belonging to that hole and the strokes counted in the usual way.

The players then proceed to the next adjacent hole and may therefore play the entire round of golf within the enclosure, each hole being different in characteristics depending upon the layout of the hazards and the position of the putting cup 16.

Due to the fact that the only drives are with a practice ball, no danger exists to adjacent players but if the practice ball does leave the confines of the individual hole being played then penalty shots can be awarded. In this connection boundary markers 32 may define the holes one from the other.

From the foregoing it will be appreciated that a representative atmosphere of a conventional golf course is achieved by full action tee shots by the golfer, putting under the same conditions on putting surfaces, having landscaped traps of sand, water, shrubs, rough grass and the like and varying the distance from the tee to each of the 18 putting cups thus permitting a 70 to 72 par course to be laid out.

Although the perimetrical fence is shown rectangular, nevertheless it will of course be appreciated that a circular area or area can be used.

Finally, the central core 11 may be enclosed within a dome 33 so that the interior can be used for all weather sports such as miniature golf, table tennis, skating or club facilities.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A golf course comprising a central core and a plurality of golf holes laid out and extending radially from said core, said core including a substantially rigid vertical wall with the golf holes extending therefrom in substantially rigid side by side relationship around said wall, and teeing areas for said golf holes adjacent the outer ends thereof, said wall comprising a plurality of rigid panels, one for each hole, and a hazard area defined on at least one of said rigid panels, said hazard area including a plurality of pins extending therefrom adapted to trap an associated practice ball striking said hazard area.

2. The course according to claim 1 which includes a wire mesh panel secured to the upper side of said wall and extending therearound and upwardly therefrom.

* * * * *